US008800270B2

(12) United States Patent
Bailey et al.

(10) Patent No.: US 8,800,270 B2
(45) Date of Patent: Aug. 12, 2014

(54) PROCESS FOR REDUCING $NO_2$ FROM COMBUSTION SYSTEM EXHAUST

(75) Inventors: Owen Herman Bailey, Lake Orion, MI (US); Robert Reginald Loucks, LaSalle (CA); Christopher Simon Owens, Melvindale, MI (US)

(73) Assignee: Umicore Autocat USA Inc., Auburn Hills, MI (US)

( * ) Notice: Subject to any disclaimer, the term of this patent is extended or adjusted under 35 U.S.C. 154(b) by 667 days.

(21) Appl. No.: 11/939,825

(22) Filed: Nov. 14, 2007

(65) Prior Publication Data

US 2009/0120076 A1 May 14, 2009

(51) Int. Cl.

| | |
|---|---|
| ***F01N 3/00*** | (2006.01) |
| ***F01N 3/10*** | (2006.01) |
| ***F01N 1/00*** | (2006.01) |

(52) U.S. Cl.

USPC ..... 60/288; 60/274; 60/301; 60/324

(58) Field of Classification Search

USPC ..... 60/274, 276, 287, 288, 295, 297, 301, 60/324; 422/170, 171, 177, 180

See application file for complete search history.

(56) References Cited

U.S. PATENT DOCUMENTS

| | | | | |
|---|---|---|---|---|
| 5,140,811 | A | | 8/1992 | Minami et al. |
| 5,349,816 | A | * | 9/1994 | Sanbayashi et al. ..... 60/277 |
| 5,603,216 | A | | 2/1997 | Guile et al. |
| 6,087,298 | A | * | 7/2000 | Sung et al. ..... 502/333 |
| 6,122,909 | A | | 9/2000 | Murphy et al. |
| 6,178,743 | B1 | | 1/2001 | Hirota et al. |
| 6,192,675 | B1 | | 2/2001 | Hirota et al. |
| 6,244,046 | B1 | | 6/2001 | Yamashita |
| 6,244,047 | B1 | | 6/2001 | Brehob et al. |
| 6,324,835 | B1 | | 12/2001 | Surnilla et al. |
| 6,428,754 | B1 | | 8/2002 | Chang et al. |

(Continued)

FOREIGN PATENT DOCUMENTS

| | | | |
|---|---|---|---|
| JP | 0893459 | | 4/1996 |
| JP | 2006-207512 | * | 8/2006 |

(Continued)

OTHER PUBLICATIONS

Japanese Office Action mailed Oct. 24, 2012 in corresponding JP 2010-534202, published Nov. 14, 2007, 3 pgs.

(Continued)

*Primary Examiner* — Thomas Denion
*Assistant Examiner* — Diem Tran
(74) *Attorney, Agent, or Firm* — Brooks Kushman P.C.

(57) ABSTRACT

An exhaust system for treating an exhaust gas composition having $NO_2$ in a first $NO_2$ concentration. The exhaust system includes a first catalyst that contacts a first portion of the exhaust gas composition converting it into a first oxidized exhaust mixture that includes $NO_2$ in a second $NO_2$ concentration that is greater than the first $NO_2$ concentration. The system further includes a bypass that receives a second portion of the exhaust gas composition and a recombination section positioned downstream of the first catalyst. The first oxidized exhaust mixture is combined with the second portion of the exhaust gas composition to produce a first combined exhaust gas mixture. A second catalyst converts the first combined exhaust gas mixture to a second combined exhaust gas mixture having a third $NO_2$ concentration that is less than the second $NO_2$ concentration. The method used by the exhaust system is also provided.

16 Claims, 5 Drawing Sheets

(56) References Cited

U.S. PATENT DOCUMENTS

| | | | | |
|---|---|---|---|---|
| 6,484,495 | B2 * | 11/2002 | Minami | 60/288 |
| 6,550,240 | B2 | 4/2003 | Kolmanovsky et al. | |
| 6,615,580 | B1 | 9/2003 | Khair et al. | |
| 6,718,757 | B2 * | 4/2004 | Khair et al. | 60/286 |
| 6,823,660 | B2 * | 11/2004 | Minami | 60/280 |
| 6,959,542 | B2 | 11/2005 | Taylor, III et al. | |
| 7,021,049 | B2 | 4/2006 | Berris et al. | |
| 7,047,730 | B2 | 5/2006 | Wang et al. | |
| 7,062,904 | B1 | 6/2006 | Hu et al. | |
| 7,062,905 | B2 | 6/2006 | Khair et al. | |
| 7,213,395 | B2 | 5/2007 | Hu et al. | |
| 7,536,999 | B2 * | 5/2009 | Ootake et al. | 123/568.21 |
| 7,673,446 | B2 * | 3/2010 | Zemskova et al. | 60/286 |
| 2006/0010859 | A1 | 1/2006 | Yan et al. | |
| 2006/0021331 | A1 | 2/2006 | Cizeron et al. | |
| 2006/0059896 | A1 | 3/2006 | Liu et al. | |
| 2006/0260297 | A1 | 11/2006 | Koch | |
| 2007/0033928 | A1 | 2/2007 | Hu et al. | |
| 2007/0056268 | A1 | 3/2007 | McCarthy, Jr. | |
| 2008/0155968 | A1 * | 7/2008 | Salemme et al. | 60/288 |
| 2008/0295499 | A1 * | 12/2008 | Driscoll et al. | 60/288 |
| 2010/0199634 | A1 * | 8/2010 | Heaton | 60/274 |

FOREIGN PATENT DOCUMENTS

| | | | |
|---|---|---|---|
| JP | 2006-207512 | A | 8/2006 |
| JP | 2006-212591 | | 8/2006 |
| KR | 1019980051022 | A | 9/1998 |

OTHER PUBLICATIONS

English Translation of Japanese Office Action mailed Jul. 1, 2013 in related case JP Appn. No. 2010-534202, pp. 1-5.

* cited by examiner

PROCESS FOR REDUCING $NO_2$ FROM COMBUSTION SYSTEM EXHAUST

BACKGROUND OF THE INVENTION

1. Field of the Invention

The present invention is related to combustion and heavy duty exhaust systems and methods for reducing nitrogen dioxide emissions.

2. Background Art

The control of $NO_2$ emissions from combustion systems, such as diesel powered equipment, is becoming an increasingly important problem worldwide. This is at least partially a result of the implementation of a variety of exhaust purification devices which while reducing emission levels of particulate matter ("PM"), CO, and/or hydrocarbons ("HC"), simultaneously oxidize NO to $NO_2$. The formation of $NO_2$ necessitates $NO_2$ suppression strategies for such systems.

Many of the prior art exhaust devices such as diesel oxidation catalysts ("DOC"), diesel particulate filters ("CDPF") and their combinations utilize Pt because of its unique oxidation activity for the conversion (i.e., oxidation) of CO, HC, and PM under oxygen-rich conditions. Pt is also the most active of the precious metal catalysts for oxidation of NO to $NO_2$. In certain prior art systems, $NO_2$ generation is actually maximized to provide $NO_2$ as an oxidant to facilitate the low temperature combustion of soot.

It is also known that $NO_2$ can react with other species such as CO and HC. Catalytic studies indicate that because of this reactivity, $NO_2$ does not begin to accumulate in significant quantities until CO and HC are largely eliminated from the reacting gas composition when passed across a precious metal catalyst. Pd is another well known catalyst for the oxidation of CO and HC and has been used broadly in after-treatment catalysts for this purpose. Numerous studies have also shown that Pd is a poor catalyst for the oxidation of NO to $NO_2$. The combination of these chemical reactivities results in exhaust systems with less than optimal $NO_2$ emission characteristics.

Accordingly, there is a need for improved exhaust systems and methods for reducing the amounts of $NO_2$ present in the exhaust of combustion systems.

SUMMARY OF THE INVENTION

The present invention solves one or more problems of the prior art by providing in at least one embodiment, a system and method for reducing the emission of $NO_2$ from combustion system. The exhaust system of this embodiment is useful for treating an exhaust gas composition that includes a mixture of carbon monoxide, hydrocarbons, $NO_2$ and particulate matter. In such exhaust compositions, the $NO_2$ is present in a first $NO_2$ concentration. The exhaust system includes a first catalyst that contacts a first portion of the exhaust gas composition. The first portion of the exhaust gas composition is converted into a first oxidized exhaust mixture that includes $NO_2$ in a second $NO_2$ concentration that is greater than the first $NO_2$ concentration. The system further includes a bypass that receives a second portion of the exhaust gas composition and a recombination section positioned downstream of the first catalyst. The first oxidized exhaust mixture is combined with the second portion of the exhaust gas composition to produce a first combined exhaust gas mixture. A second catalyst is positioned downstream of the first catalyst. The second catalyst converts the first combined exhaust gas mixture to a second combined exhaust gas mixture. The second combined exhaust gas mixture has $NO_2$ present in a third $NO_2$ concentration that is less than the second $NO_2$ concentration such that a portion of the $NO_2$ in the first oxidized exhaust mixture is converted to NO.

In a variation of the present invention, the differing catalytic activities of Pt and Pd are advantageously applied. Pt is known to efficiently oxidize carbon monoxide and hydrocarbons in diesel exhausts. Pt also promotes oxidation of NO to nitrogen dioxide. However, the latter oxidation is not appreciably observed until relatively late in the exhaust when the carbon monoxide and hydrocarbons are depleted. Pd also promotes the oxidation of carbon monoxide and hydrocarbons. However, it does not efficiently promote the oxidation of NO. In the present invention, a palladium-containing catalyst is positioned downstream of a platinum-containing catalyst in a diesel exhaust. A first portion of the exhaust enters the platinum-containing catalyst. A second portion of the exhaust bypasses the platinum-containing catalyst. The second portion of the exhaust, which still contains carbon monoxide and hydrocarbons is combined with the first portion which has passed through the platinum-containing catalyst. At this point the first portion includes significant levels of nitrogen dioxide. The combined first and second portions are then passed through the palladium-containing catalyst where the nitrogen dioxide is consumed in oxidizing the carbon monoxide and hydrocarbons from the second portion. The overall result is a reduction in nitrogen dioxide emissions. Suitably designed base metal catalysts may function similarly to the palladium-containing catalyst with regard to $NO_2$ reduction.

DETAILED DESCRIPTION OF THE PREFERRED EMBODIMENT(S)

Figure 1A:
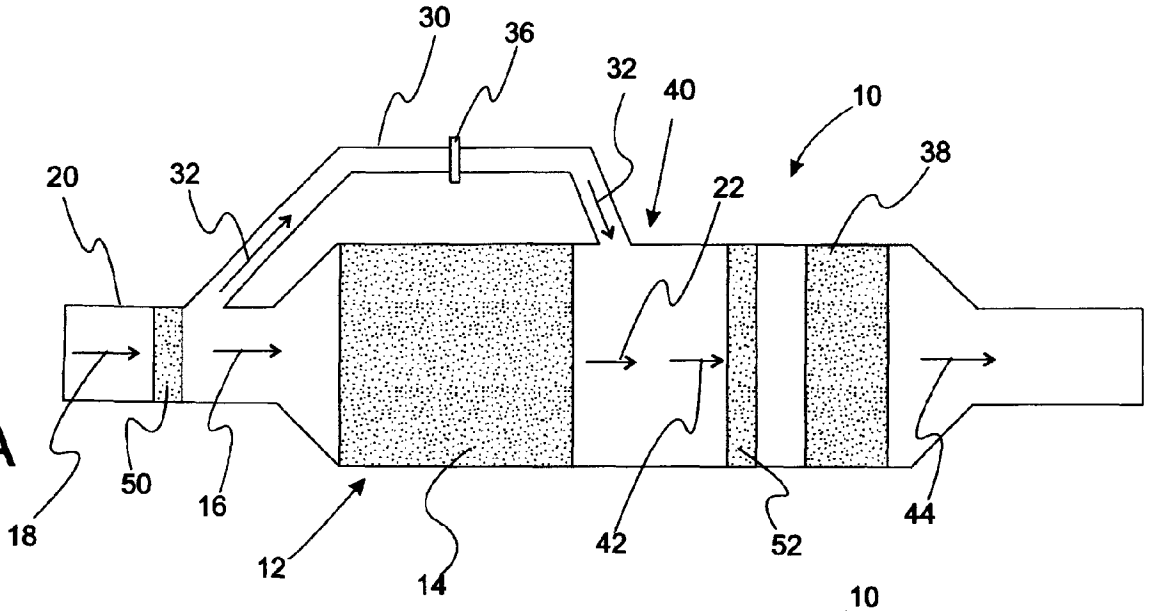
FIG. 1A is a schematic illustration of a exhaust system using a bypass around a filter system.

Reference will now be made in detail to presently preferred compositions, embodiments and methods of the present invention, which constitute the best modes of practicing the invention presently known to the inventors. The Figures are not necessarily to scale. However, it is to be understood that the disclosed embodiments are merely exemplary of the invention that may be embodied in various and alternative forms. Therefore, specific details disclosed herein are not to be interpreted as limiting, but merely as a representative basis for any aspect of the invention and/or as a representative basis for teaching one skilled in the art to variously employ the present invention.

Except in the examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. The description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

It is also to be understood that this invention is not limited to the specific embodiments and methods described below, as specific components and/or conditions may, of course, vary. Furthermore, the terminology used herein is used only for the purpose of describing particular embodiments of the present invention and is not intended to be limiting in any way.

It must also be noted that, as used in the specification and the appended claims, the singular form "a," "an," and "the" comprise plural referents unless the context clearly indicates otherwise. For example, reference to a component in the singular is intended to comprise a plurality of components.

Throughout this application, where publications are referenced, the disclosures of these publications in their entireties are hereby incorporated by reference into this application in their entirety to more fully describe the state of the art to which this invention pertains.

A process is disclosed which utilizes Pd to treat an $NO_2$-containing exhaust gas stream by catalyzing the reaction of the $NO_2$ with an available reductant. In most exhaust gas streams, reductants such as CO and HC are reduced to extremely low levels by the Pt-containing aftertreatment components provided to control those pollutants. As a result, a suitable reductant must be provided to facilitate the desired $NO_2$ conversion. In another variation, suitably designed base metal catalysts may be deployed in place of or in combination with the palladium-containing catalyst with regard to $NO_2$ reduction. The term "base metal" refers to a common metal that corrodes, tarnishes, or oxidizes on exposure to air, moisture, or heat. Examples of such metals include, but are not limited to, iron, nickel, copper, nickel, cobalt, and the like.

Figure 1B:
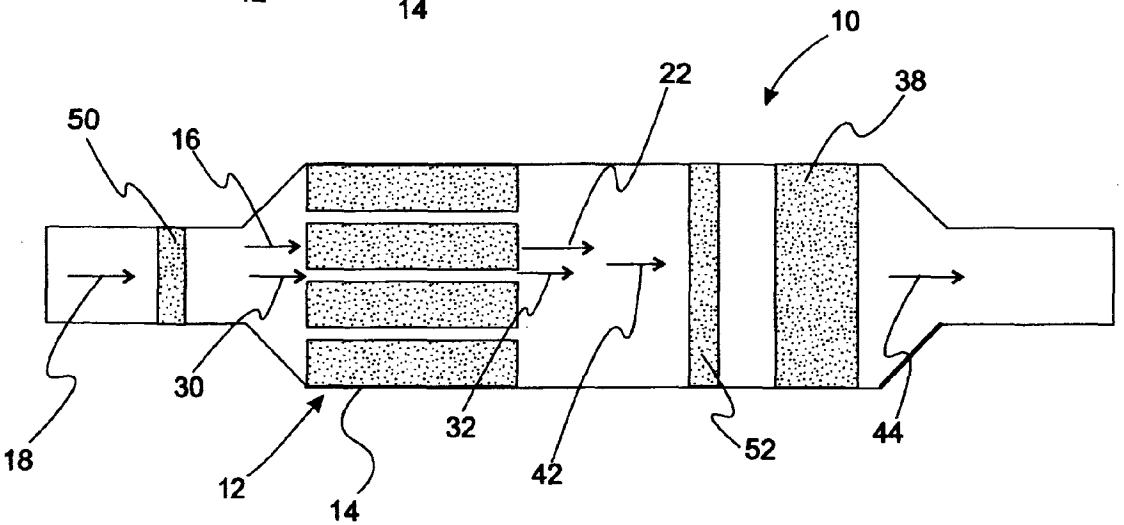
FIG. 1B is a schematic illustration of a exhaust system using a bypass that goes through a filter system or a diesel oxidation catalyst ("DOC") system.

With reference to FIGS. 1A and 1B, a schematic illustration of an exhaust system for reducing the amount of $NO_2$ in an exhaust gas composition is provided. FIG. 1A is a schematic illustration of an exhaust system using a bypass around a filter or DOC system. FIG. 1B is a schematic illustration of an exhaust system using a bypass that goes through a filter or DOC system. Useful exhaust systems include, but are not limited to, vehicle exhaust systems treating the exhaust of an internal combustion engine. In particular, the present embodiment is useful for treating the exhaust of a diesel engine. One $NO_2$ source that may be treated with the present invention include, but are not limited to, $NO_2$ engines, burners, catalysts, or plasma electrical discharge reactors. Exhaust gas system 10 includes first catalyst component 12 which include first catalyst 14 that contacts first portion 16 of exhaust gas composition 18. Exhaust gas composition 18 is provided to first catalyst component 12 via inlet conduit 20. Exhaust gas composition 18 typically is a mixture of carbon monoxide, hydrocarbons, organic particulate material, and $NO_x$ (e.g., NO and $NO_2$). Characteristically, the $NO_2$ in exhaust composition 18 is present in a first $NO_2$ concentration. In one variation, the first $NO_2$ concentration is from about 5 ppm to about 10 volume % of the exhaust gas composition. In another variation, the first $NO_2$ concentration is from about 10 ppm to about 5 volume % of the exhaust gas composition. First portion 16 is converted into first oxidized exhaust composition 22. First oxidized exhaust composition 22 includes $NO_2$ in a second $NO_2$ concentration that is greater than the first $NO_2$ concentration. In a variation of the present embodiment, the second $NO_2$ concentration is from about 10 ppm to about 20 volume % of the exhaust gas composition. In another variation of the present embodiment, the second $NO_2$ concentration is from about 5 ppm to about 9.5 volume % of the exhaust gas composition.

Still referring to FIGS. 1A and 1B, a supply of reductant is provided to first oxidized exhaust composition 22. The supply of reductant for this $NO_2$ reaction is controlled by a variety of means, both passive and active. In a variation of the present embodiment, catalyst component 12 includes bypass 30 which operates passively to supply reductant. Bypass 30 is typically a conduit (e.g., a pipe) that receives second portion 32 of exhaust gas mixture 18. Moreover, bypass 30 diverts second portion 32 of exhaust gas composition 18 around the emission control device(s) (i.e., first catalyst system 14) which are responsible for the desired oxidation of CO, hydrocarbons, and particulate material as illustrated in FIG. 1A. This stream is mixed with the $NO_2$-containing primary exhaust line containing first oxidized exhaust composition 22 which is then reacted over second catalyst system 38 (typically a Pd catalyst) to convert a portion of the main stream's $NO_2$ to NO. In other refinements, bypass 30 comprises a conduit through first catalyst 14 as illustrated in FIG. 1B. In this variation, the diameter and the positioning of bypass 30, along with upstream and downstream pressures and flow rates, determine the amount of unreacted gas and associated reductants delivered to catalyst component 38 for reaction with $NO_2$. To facilitate manufacturing, a common large bypass line might be provided for a range of applications and an adjustable valve included in the bypass to allow for flow adjustment to provide the specific level of $NO_2$ control for an individual application. It is also recognized that the relative size of this flow and associated reaction may compromise the originally-designed performance of the main aftertreatment system for CO, hydrocarbons, and particulate material.

In another variation of the present embodiment, a supply of reductant is provided to first oxidized exhaust composition 22 by a system utilizing dynamic regulation. In this variation, exhaust gas system 10 include valve 36 which regulates flow into bypass 30. A controller (not shown) in communication with valve 36 implements a control strategy for optimizing system performance. Specifically, since $NO_2$ formation is typically under both kinetic and thermodynamic control at different operating conditions, the delivery of reductant through bypass 30 is optimized to maximize $NO_2$ reduction while minimizing any loss of other emission control functionality.

In another variation of the present invention, a reductant for $NO_2$ conversion of first oxidized exhaust composition 22 is provided by direct incorporation of a solid reductant within second catalyst component 38. This variation is particularly useful when second catalyst component 38 includes palladium. An example of a useful solid reductant is a high surface area carbon. It should be appreciated that the solid reductant in this variation is progressively consumed thereby necessitating that an adequate quantity of reductant be incorporated into second catalyst component 38 to ensure operation for extended periods of time.

It is appreciated by those skilled in the art that a variety of bypass systems are useful in the present embodiment. These include, but are not limited to, incorporation of uncatalyzed zones upstream of second catalyst component 38 that provide a mechanism for unreacted gas (including reductants) to reach second catalyst component 38 for reaction with $NO_2$. Bypass 30 may be incorporated directly into the converter can rather than as an uncatalyzed path through the catalyst itself. This concept is suitable for both honeycomb (metallic or ceramic, including wall or channel flow designs) or pelleted catalyst beds. In other variations, reductants are supplied via fuel injectors or drip pipes which supply some type of reactive liquid or gas directly upstream of the Pd catalyst.

Still referring to FIGS. 1A and 1B, exhaust system 10 includes recombination section 40 that is positioned downstream of first catalyst component 12 such that first oxidized exhaust composition 22 is combined with second portion 32 of exhaust gas composition 18 to produce first combined exhaust gas mixture 42. Second catalyst component 38 is positioned downstream of first catalyst component 12. Second catalyst component 38 converts first combined exhaust gas mixture 42 into second combined exhaust gas mixture 44. Second combined exhaust gas mixture 44 is present in a third $NO_2$ concentration that is less than the second $NO_2$ concentration such that a portion of the $NO_2$ in the first oxidized exhaust mixture is converted to NO.

Still referring to FIG. 1, first catalyst 14 and second catalyst component 38 each independently comprise catalytic material. In a further refinement, first catalyst 14 and second catalyst component 38 include a substrate such that catalytic material is disposed on or within the substrate. In one variation, the catalytic material includes a precious metal. Typically, the catalytic material in first catalyst 14 comprises platinum in an amount from about 0.1 to 300 g/cubic foot. In another refinement, the catalytic material in first catalyst 14 comprises platinum in an amount from about 30 to 50 g/cubic foot. Similarly, the catalytic material in second catalyst component typically comprises palladium in an amount from about 2 to 300 g/cubic foot. In another refinement, the catalytic material in second catalyst 38 comprises palladium in an amount from about 50 to 200 g/cubic foot. In another refinement, the substrate comprises a porous material which may be fibrous. In another variation, the substrate includes a material selected from the group consisting of cordierite, metals, and ceramic. In some variations of the present embodiment, the substrate has a honey comb structure. In other variations the substrate is a foam or a bead or plurality of beads.

In a variation of the present embodiment, exhaust system 10 further includes one or more additional exhaust components 50, 52. Exhaust components 50, 52 are positioned upstream of first catalyst 14 and/or second catalyst component 38. Examples of useful additional exhaust components include, but are not limited to, exhaust catalysts, filters, foam-based components, and combinations thereof. When component 52 includes a catalyst, a bypass around or through component 52 may be used to allow a portion of the reductants to avoid the catalyst. In one refinement, first catalyst 14 and/or second catalyst component 38 is a filter that may or may not contain a catalyst. Such filters may also include a foam or plurality of beads operating as a filter component. Specific examples of such additional exhaust components also include diesel oxidation catalysts, NOx traps (e.g., base metal catalysts, SCR systems, coated or uncoated filters, and the like).

Figure 2A:
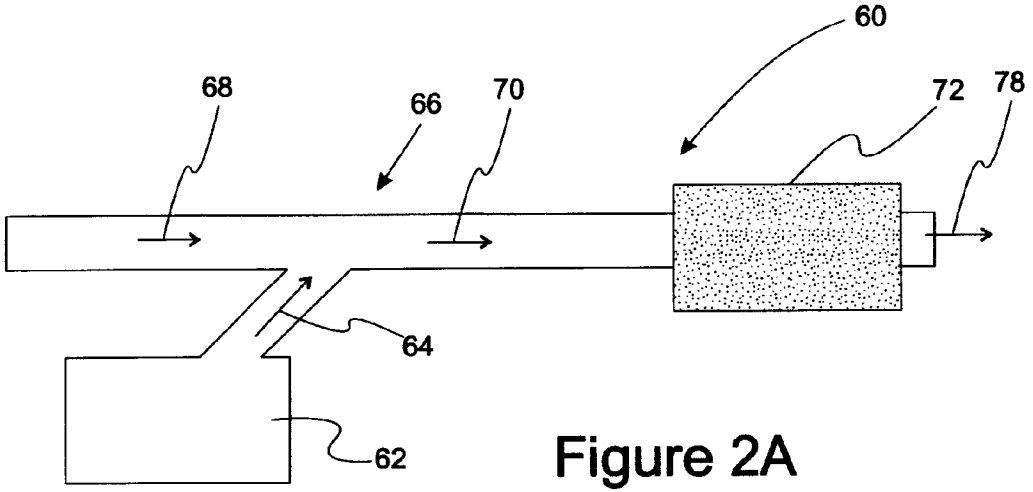
FIG. 2A is a schematic illustration of an off-line system for reducing $NO_2$ emissions from a $NO_2$ source.
Figure 2B:
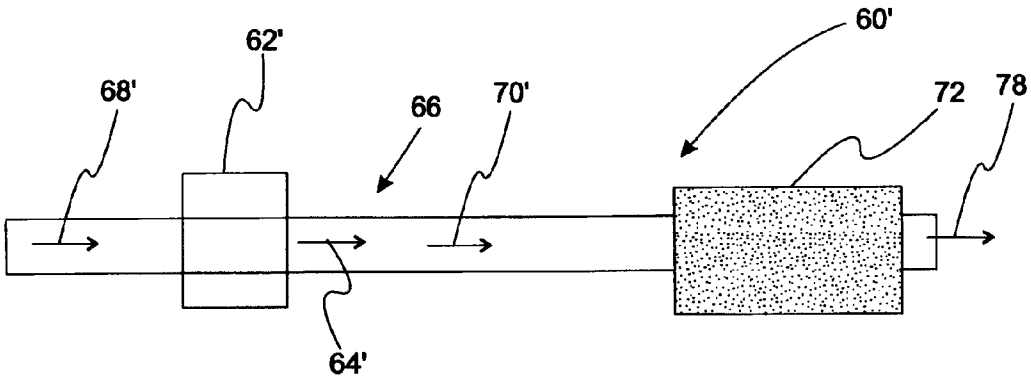
FIG. 2B is a schematic illustration of an in-line system for reducing $NO_2$ emissions from a $NO_2$ source.

In another embodiment of the present invention, a $NO_2$ reducing system for reducing the amount of $NO_2$ in a $NO_2$-containing mixture is provided. Typically, such $NO_2$-containing mixtures include a mixture of carbon monoxide, hydrocarbons, and $NO_2$ as set forth above with $NO_2$ being present in a first $NO_2$ concentration. FIGS. 2A and 2B provides schematic illustrations of an off-line system for reducing $NO_2$ emissions from a $NO_2$ source. FIG. 2A depicts an off-line system while FIG. 2B depicts an in-line system.

With reference to FIG. 2A, $NO_2$ reducing system 60 includes off-line $NO_2$ source 62 that provides $NO_2$-containing composition 64 in a first $NO_2$ concentration and recombination section 66 that receives exhaust gas composition 68 and the $NO_2$ containing composition 64 to form first combined exhaust gas mixture 70. Catalyst system 72 is positioned downstream of $NO_2$ source 62. Catalyst system 72 converts first combined exhaust gas mixture 70 to second combined exhaust gas mixture 78. Second combined exhaust gas composition 78 includes $NO_2$ present in a second output $NO_2$ concentration. The second output $NO_2$ concentration is less than the first output $NO_2$ concentration such that a portion of the $NO_2$ in first oxidized exhaust mixture 70 is converted to NO. Examples for $NO_2$ source 62 include, but are not limited to, an engine, a catalyst, plasma electrical discharge reactor, and the like.

With reference to FIG. 2B, $NO_2$ reducing system 60' includes optional inline $NO_2$ source 62' that provides $NO_2$-containing composition 64' which combines with exhaust gas composition 68' to form first combined exhaust gas mixture 70' having $NO_2$ in a first $NO_2$ concentration. In a refinement for the present embodiment, a reductant such as hydrocarbons may be injected upstream of $NO_2$ source 62'. Catalyst system 72 is positioned downstream of $NO_2$ source 62. Catalyst system 72 converts first combined exhaust gas mixture 70 to second combined exhaust gas mixture 78. Second combined exhaust gas composition 78 includes $NO_2$ present in a second output $NO_2$ concentration. The second output $NO_2$ concentration is less than the first output $NO_2$ concentration such that a portion of the $NO_2$ in first oxidized exhaust mixture 70 is converted to NO. Examples for $NO_2$ source 62' include, but are not limited to, an engine, a catalyst, plasma electrical discharge reactor, and the like.

In still another embodiment of the present invention, a method for reducing the amount of $NO_2$ utilizing the embodiment of the apparatus set forth above is provided. Typically, the methods are deployed on the exhaust gas composition of an internal combustion engine. The method of this embodiment comprises a first portion of a $NO_2$ containing composition with a first catalyst. The first portion of the exhaust gas mixture is converted into a main oxidized exhaust mixture comprising $NO_2$ in a second $NO_2$ concentration that is greater than the first $NO_2$ concentration. A second portion of the exhaust gas mixture passes through a bypass and is then combined with the first oxidized gas mixture at a position downstream of the first catalyst to produce a combined exhaust gas mixture. Next, the combined exhaust gas mixture is contacted with a second catalyst positioned downstream of the first catalyst. Characteristically, the second catalyst converts the combined exhaust gas mixture to a second combined exhaust gas mixture having $NO_2$ present in a third $NO_2$ concentration. Advantageously, this third $NO_2$ concentration is less than the second $NO_2$ concentration such that a portion of the $NO_2$ in the first oxidized exhaust mixture is converted to NO.

Figure 3:
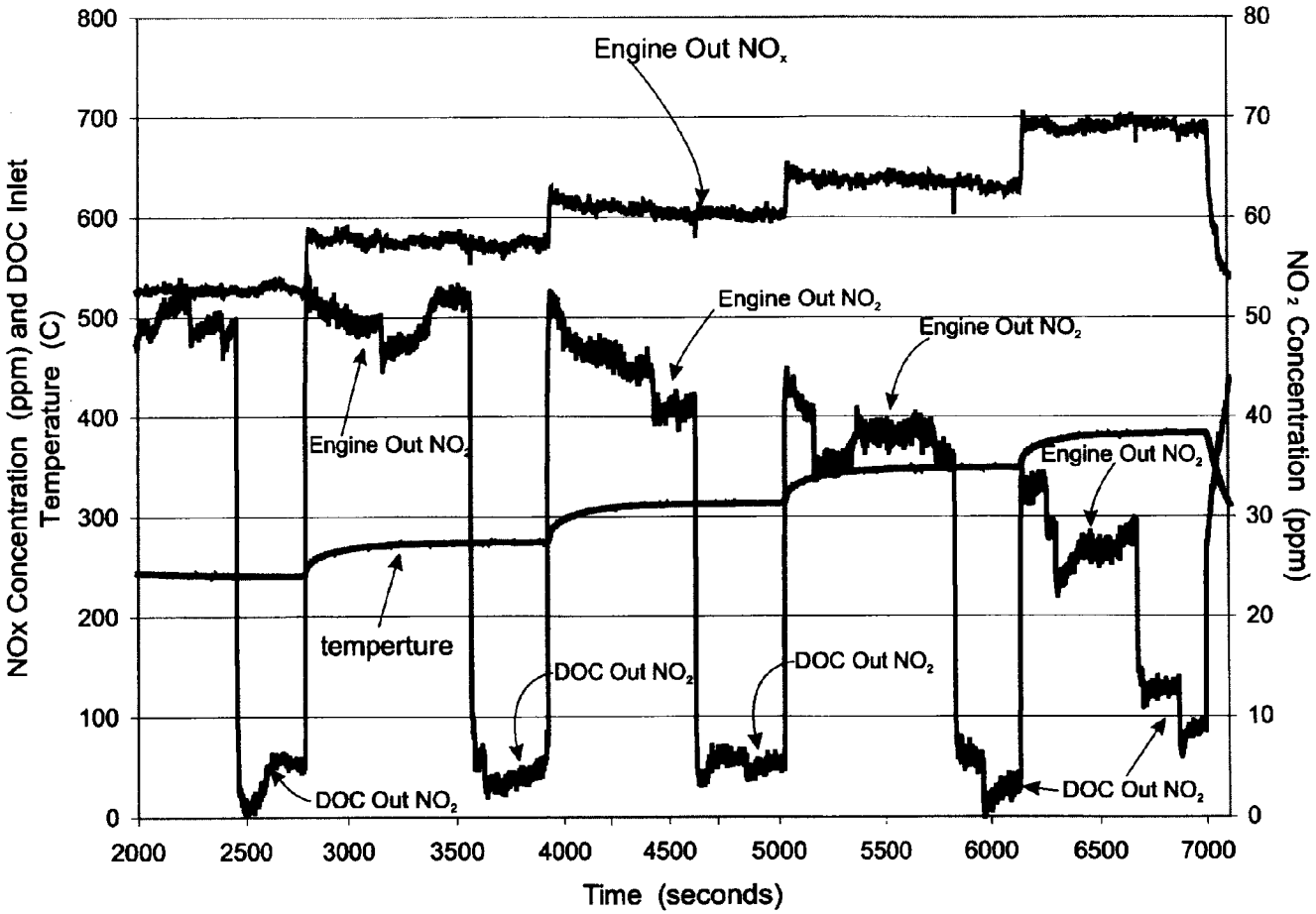
FIG. 3 provides plots of an engine exhaust NOx output, $NO_2$ output, temperature, and a diesel oxidation catalyst ("DOC") utilizing an embodiment of the invention.
Figure 4:
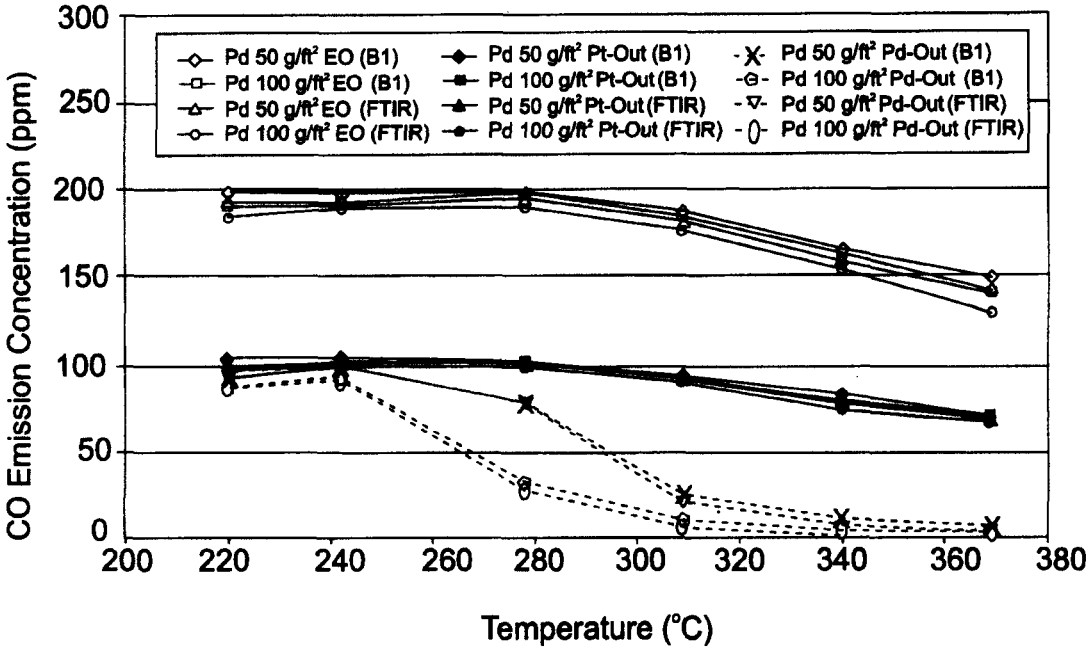
FIG. 4 provides plots of the carbon monoxide concentrations within an example exhaust gas system corresponding to FIGS. 2A and 2B.
Figure 5:
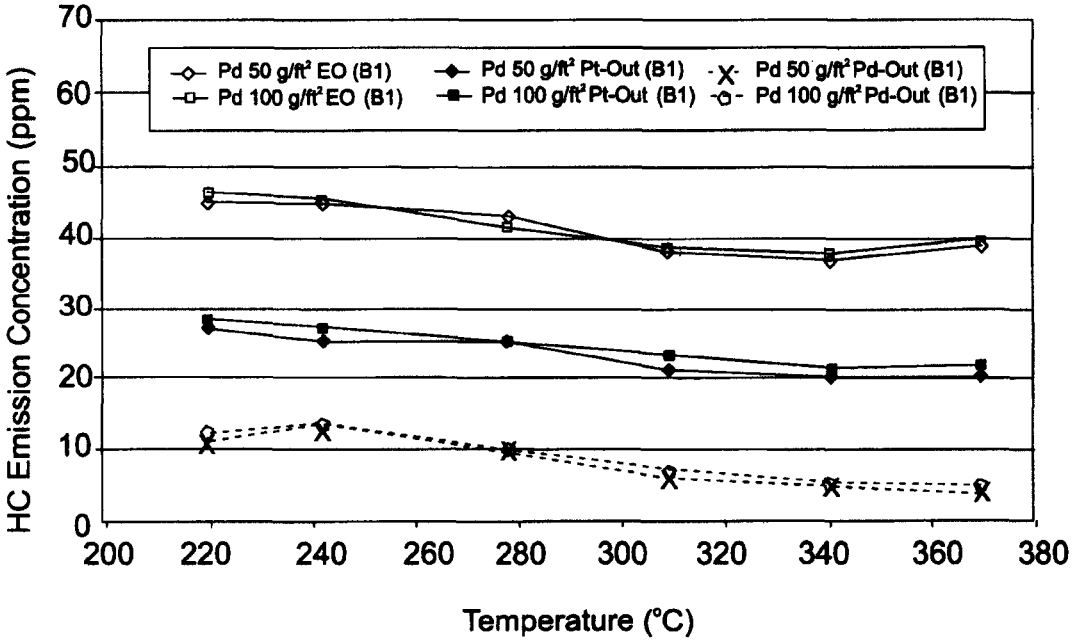
FIG. 5 provides plots of the hydrocarbon concentration within an example exhaust gas system corresponding to FIGS. 2A and 2B.
Figure 6:
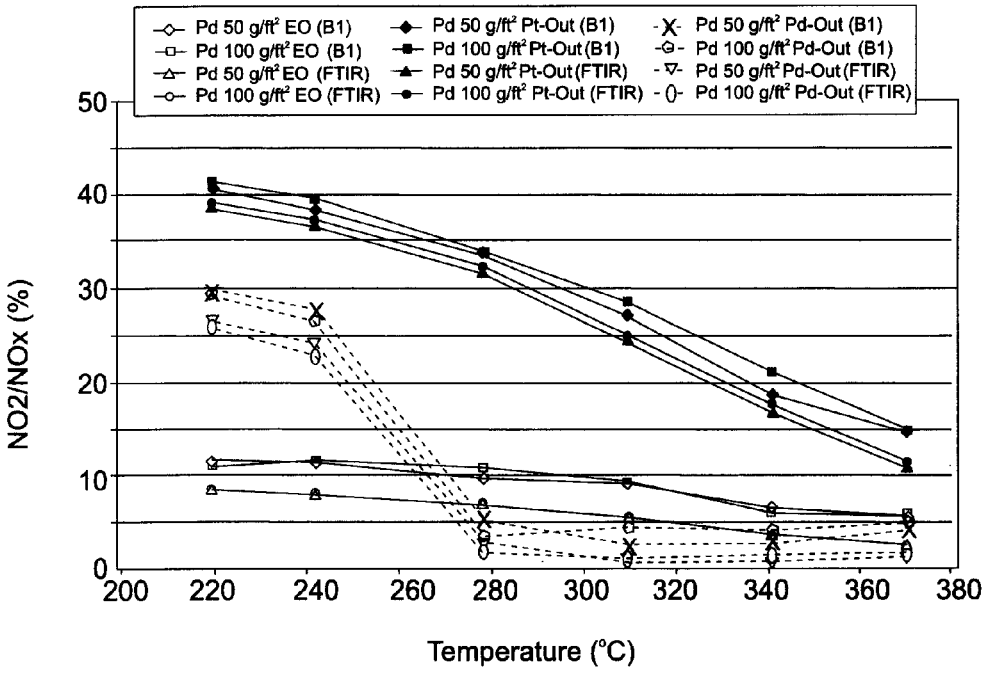
FIG. 6 provides plots of the $NO_2$ to NOx within an example exhaust gas system corresponding to FIGS. 2A and 2B.
Figure 7:
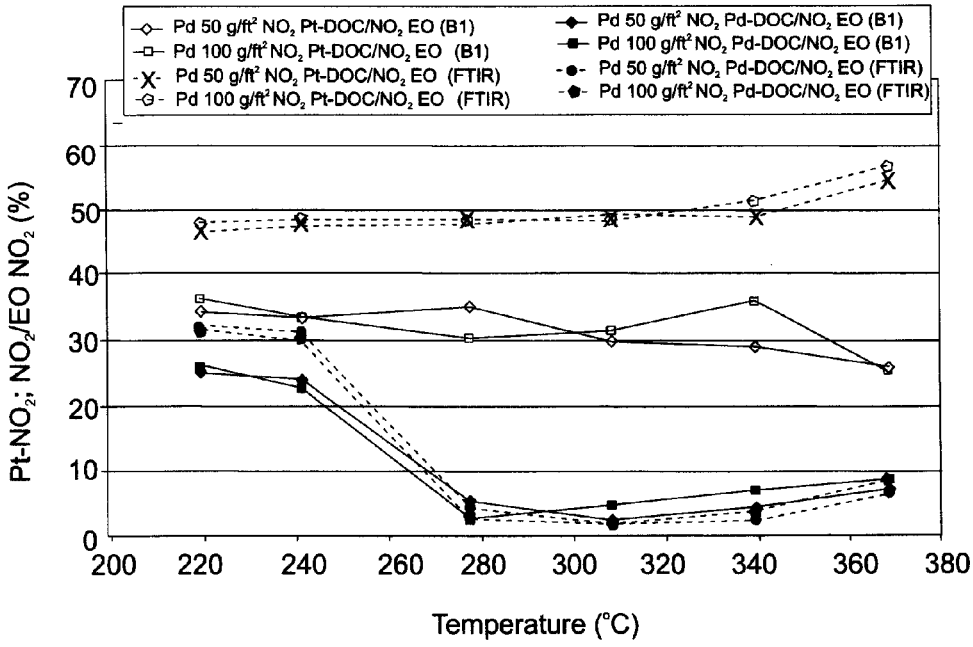
FIG. 7 provides plots of the $NO_2$ after the platinum and palladium catalysts to the $NO_2$ in the exhaust output within an example exhaust gas system corresponding to FIGS. 2A and 2B.

The utility of the present invention may be appreciated by reference to FIGS. 3-8. FIG. 3 provides plots of an engine exhaust NOx output, $NO_2$ output, temperature, and a diesel oxidation catalyst ("DOC") utilizing an embodiment of the invention. FIG. 3 readily demonstrates the reduced $NO_2$ emission as compared to the amounts output from the engine. FIG. 4 provides plots of the carbon monoxide concentrations at various locations for a configuration in which an exhaust is contacted with a platinum catalyst and then a palladium catalyst with a portion of the exhaust bypassing the platinum catalyst. The CO concentrations for the engine output ("EO"), the platinum catalyst output ("platinum out") and the palladium catalyst output (palladium out") are provided. At temperatures over 280° C., the CO concentration out of the palladium catalyst is clearly reduced over the engine out and the platinum out. FIG. 5 provides plots of the hydrocarbon outputs from the engine, platinum catalyst, and palladium catalyst. In the temperature range from 220° C. to 370° C., the concentration of hydrocarbons is lower after the platinum catalyst than in the engine exhaust and even lower after the palladium catalyst. FIG. 6 provides plots of the $NO_2$ to NOx ratios output from the engine, platinum catalyst, and palladium catalyst. At temperatures from 280° C. to 370° C., the $NO_2$ to NOx ratios out of the palladium catalyst are advantageously very reduced. FIG. 7 provides plots of the $NO_2$ after the platinum and palladium catalysts to the $NO_2$ in the engine output. In the temperature range 200° C. to 370° C., this ratio is observed to be very reduced thereby in combination with FIG. 6 illustrating the function of embodiments of the invention in reducing $NO_2$ from an exhaust.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method for reducing an amount of $NO_2$ in an exhaust gas mixture of an internal combustion engine, the exhaust gas mixture having a mixture of carbon monoxide, hydrocarbons, and $NO_2$, the $NO_2$ being present in a first $NO_2$ concentration, the method comprising:

contacting a first portion of the exhaust gas mixture with a first catalyst, the exhaust mixture being a diesel exhaust, the first catalyst including platinum in an amount from about 0.1 to 300 g/cubic foot, the first portion of the exhaust gas mixture being converted into a first oxidized exhaust mixture comprising $NO_2$ in a second $NO_2$ concentration, the second $NO_2$ concentration being greater than the first $NO_2$ concentration;

passing a second portion of the exhaust gas mixture through a bypass;

combining the second portion of the exhaust gas mixture with the first oxidized exhaust mixture at a position downstream of the first catalyst to produce a combined exhaust gas mixture; and contacting the combined exhaust gas mixture with a second catalyst positioned downstream of the first catalyst such that $NO_2$ is consumed in oxidizing the carbon monoxide and hydrocarbons from the second portion, the second catalyst including palladium in an amount from about 2 to 300 g/cubic foot, the second catalyst converting the combined exhaust gas mixture to a second combined exhaust gas mixture, the second combined exhaust gas mixture having $NO_2$ present in a third $NO_2$ concentration, the third $NO_2$ concentration being less that the second $NO_2$ concentration such that a portion of the $NO_2$ in the first oxidized exhaust mixture is converted to NO, a diameter and the positioning of the bypass determining an amount of unreacted gas and associated reductants delivered to the second catalyst.

2. The method of claim 1 wherein the first $NO_2$ concentration is from about 5 ppm to about 10 volume % of the exhaust gas mixture.

3. The method of claim 1 wherein the first $NO_2$ concentration is from about 10 ppm to about 5 volume % of the exhaust gas mixture.

4. The method of claim 1 wherein the second $NO_2$ concentration is from about 10 ppm to about 20 volume % of the exhaust gas mixture.

5. The method of claim 1 wherein the second $NO_2$ concentration is from about 5 ppm to about 9.5 volume % of the exhaust gas mixture.

6. The method of claim 1 wherein the first catalyst comprises platinum in an amount from about 30 to 50 g/cubic foot.

7. The method of claim 1 wherein the bypass includes a valve for varying an amount of exhaust flowing through the bypass, the valve being operated to maximize $NO_2$ reduction while minimizing any loss of other emission control functionality.

8. The method of claim 1 wherein the bypass comprises a conduit around the first catalyst.

9. A method for reducing an amount of $NO_2$ in an exhaust gas mixture of an internal combustion engine, the exhaust gas mixture having a mixture of carbon monoxide, hydrocarbons, and $NO_2$, the $NO_2$ being present in a first $NO_2$ concentration, the method consisting of:

contacting a first portion of the exhaust gas mixture with a first catalyst, the first catalyst including platinum in an amount from about 0.1 to 300 g/cubic foot, the exhaust mixture being a diesel exhaust, the first catalyst including a first precious metal, the first portion of the exhaust gas mixture being converted into a first oxidized exhaust mixture comprising $NO_2$ in a second $NO_2$ concentration, the second $NO_2$ concentration being greater than the first $NO_2$ concentration;

passing a second portion of the exhaust gas mixture through a bypass;

combining the second portion of the exhaust gas mixture with the first oxidized exhaust mixture at a position downstream of the first catalyst to produce a combined exhaust gas mixture; and contacting the combined exhaust gas mixture with a second catalyst positioned downstream of the first catalyst such that $NO_2$ is consumed in oxidizing the carbon monoxide and hydrocarbons from the second portion, the second catalyst including palladium in an amount from about 2 to 300 g/cubic foot, the second catalyst including palladium, the second catalyst converting the combined exhaust gas mixture to a second combined exhaust gas mixture, the second combined exhaust gas mixture having $NO_2$ present in a third $NO_2$ concentration, the third $NO_2$ concentration being less than the second $NO_2$ concentration such that a portion of the $NO_2$ in the first oxidized exhaust mixture is converted to NO, a diameter and the positioning of the bypass determining an amount of unreacted gas and associated reductants delivered to the second catalyst.

10. The method of claim 9 wherein the first $NO_2$ concentration is from about 5 ppm to about 10 volume % of the exhaust gas mixture.

11. The method of claim 9 wherein the first $NO_2$ concentration is from about 10 ppm to about 5 volume % of the exhaust gas mixture.

12. The method of claim 9 wherein the second $NO_2$ concentration is from about 10 ppm to about 20 volume % of the exhaust gas mixture.

13. The method of claim 9 wherein the second $NO_2$ concentration is from about 5 ppm to about 9.5 volume % of the exhaust gas mixture.

14. The method of claim 9 wherein the first catalyst comprises platinum in an amount from about 30 to 50 g/cubic foot.

15. The method of claim 9 wherein the bypass includes a valve for varying an amount of exhaust flowing through the bypass, the valve being operated to maximize $NO_2$ reduction while minimizing any loss of other emission control functionality.

16. The method of claim 9 wherein the bypass comprises a conduit around the first catalyst.

* * * * *